US006659792B2

(12) United States Patent
Saka et al.

(10) Patent No.: US 6,659,792 B2
(45) Date of Patent: Dec. 9, 2003

(54) ELECTRIC CONNECTION BOX

(75) Inventors: Yuuji Saka, Mie (JP); Eriko Yuasa, Mie (JP); Takamichi Miyamukai, Mie (JP); Hiroyuki Hayashi, Mie (JP); Isao Yoneyama, Chiryu (JP); Keiichi Ito, Aichi (JP); Yoshihide Tsukamoto, Nisshin (JP); Masahiro Takamatsu, Toyota (JP); Koji Nomura, Toyota (JP)

(73) Assignees: Autonetworks Technologies, Limited, Mie (JP); Sumitomo Wiring Systems, Limited, Osaka (JP)

( * ) Notice: Subject to any disclaimer, the term of this patent is extended or adjusted under 35 U.S.C. 154(b) by 0 days.

(21) Appl. No.: 10/303,958

(22) Filed: Nov. 26, 2002

(65) Prior Publication Data

US 2003/0109150 A1 Jun. 12, 2003

(30) Foreign Application Priority Data

Dec. 4, 2001 (JP) ..... 2001-370477

(51) Int. Cl.[7] ..... H01R 13/62
(52) U.S. Cl. ..... 439/367; 174/50.52; 174/59
(58) Field of Search ..... 439/367, 521, 439/949, 76.2; 174/59, 50.52, 52.1

(56) References Cited

U.S. PATENT DOCUMENTS 5,295,842 A * 3/1994 Ozaki et al. ..... 439/76.2
5,718,598 A * 2/1998 Saka et al. ..... 439/404
5,755,579 A * 5/1998 Yanase et al. ..... 439/76.2
5,868,583 A * 2/1999 Naitou et al. ..... 439/76.2
5,882,213 A * 3/1999 Witek et al. ..... 439/76.2
5,915,978 A * 6/1999 Hayakawa et al. ..... 439/76.2
5,995,380 A * 11/1999 Maue et al. ..... 361/826
6,022,247 A * 2/2000 Akiyama et al. ..... 439/701
6,126,458 A * 10/2000 Gregory et al. ..... 439/76.2
6,524,136 B2 * 2/2003 Kawaguchi et al. ..... 439/621
6,540,543 B1 * 4/2003 Watanabe ..... 439/354

FOREIGN PATENT DOCUMENTS

JP A 2001-218335 8/2001

* cited by examiner

*Primary Examiner*—Ross Gushi
(74) *Attorney, Agent, or Firm*—Oliff & Berridge, PLC

(57) ABSTRACT

An electric connection box includes a cover fitted on a lower side of a body having mounting portions, and the cover is fixedly secured to a vehicle body. A wire harness is extended outwardly from a portion of the body, disposed near to one corner portion thereof, through an escape groove. Plural lock mechanisms, in which a lock piece portion can be elastically fitted into a lock groove, are provided at fitting peripheral surfaces of the body and cover, and are disposed near to four corner portions thereof respectively. One lock mechanism, disposed near to a position where the wire harness is extended outwardly, has a semi-lock structure, and thus has a smaller retaining force than the other lock mechanisms.

3 Claims, 3 Drawing Sheets

ELECTRIC CONNECTION BOX

BACKGROUND OF THE INVENTION

1. Field of the Invention

This invention relates to an electric connection box such as a junction box.

2. Description of the Related Art

One example of known junction boxes comprises a body having electrical parts (such as relays and fuses) mounted thereon, and a cover attached to a lower surface of the body. A wire harness is extended outwardly from a predetermined portion of the body. A plurality of elastically-deformable lock piece portions are formed on and project from the body, and lock portions, corresponding respectively to the lock piece portions, are formed at the cover. The lock piece portions are elastically deformed to be retainingly engaged with the lock portions respectively, thereby connecting the cover to the lower surface of the body in a united manner. This cover is fixedly secured to a vehicle body by screws.

This kind of junction box is disclosed, for example, in JP-A-2001-218335.

When disassembling a vehicle, such a junction box is removed from a vehicle body for assorting recovery purposes or other purposes. At this time, for the purpose of saving the time and for other purposes, the whole of the box is not removed by loosening the screws, but only the body is withdrawn from the cover by gripping and pulling the wire harness, with the cover remaining on the vehicle body. On the other hand, when the junction box is in use, a predetermined force of connection between the cover and the body is required, and therefore lock mechanisms are provided respectively at a plurality of portions to increase the connecting force, and therefore when withdrawing the body from the cover as described above, this operation can not be effected easily, causing a problem that much time and labor are required for the disassembling operation.

SUMMARY OF THE INVENTION

An object of the invention is to provide a connecting structure which provides a high retaining force and facilitates a disassembling operation.

According to a first aspect of the invention, there is provided an electric connection box comprising: a connection box body having electrical parts such as a relay and a fuse mounted thereon; a wire harness being extended outwardly from a predetermined portion of the connection box body; a cover attached to one surface of the connection box body; and a plurality of lock mechanisms being disposed respectively at regions between the connection box body and the cover, wherein one of the lock mechanisms, disposed near to a position where the wire harness is extended outwardly, has a smaller retaining force than that of the other lock mechanisms.

According to a second aspect of the invention, each of the lock mechanisms includes an elastically-deformable lock piece portion provided at one of the connection box body and the cover, and a lock portion provided at the other so as to be retainingly engaged with the lock piece portion, and in the lock mechanism having the smaller retaining force, at least one of mating surfaces of the lock piece portion and the lock portion, which can be retainingly engaged with each other, is tapering to provide a semi-lock structure.

According to a third aspect of the invention, each of the lock mechanisms includes an elastically-deformable lock piece portion provided at one of the connection box body and the cover, and a lock portion provided at the other so as to be retainingly engaged with the lock piece portion, and in the lock mechanism having the smaller retaining force, the lock piece portion is disposed in such a posture that the lock piece portion can be easily broken at a proximal end portion thereof when a force, acting to separate the lock piece portion from the lock portion, is applied to the lock piece portion.

According to the first aspect, the cover is fixedly secured to a fixing member, and in this condition when the wire harness is gripped and pulled in a predetermined direction, the lock mechanism, which is disposed near to the position where the wire harness is extended outwardly and has the relatively-small retaining force, is unlocked, and part of the body is withdrawn from the cover, and subsequently the other lock mechanisms, while subjected to an inertia force of this withdrawing operation, are unlocked in a chain-like manner, and the body is withdrawn from the cover.

Only that lock mechanism, disposed near to the position where the wire harness is extended outwardly, has the smaller retaining force, and the required overall retaining force is secured, and the withdrawal of the body can be effected relatively easily.

According to the second aspect, the lock mechanism, disposed near to the position where the wire harness is extended outwardly, has the semi-lock structure, and therefore this lock mechanism can be relatively easily unlocked when the wire harness is pulled.

According to the third aspect, in the lock mechanism, disposed near to the position where the wire harness is extended outwardly, the lock piece portion is broken at its proximal end portion when the wire harness is pulled, so that the locked condition is canceled.

DETAILED DESCRIPTION OF THE PREFERRED EMBODIMENTS

Preferred embodiments of the present invention will be described with reference to the accompanying drawings.

(First Embodiment)

A first embodiment of the present invention will be described with reference to FIGS. 1 to 5. In this embodiment, the invention is applied to a junction box 10 (hereinafter referred to as "J/B").

Figure 1:
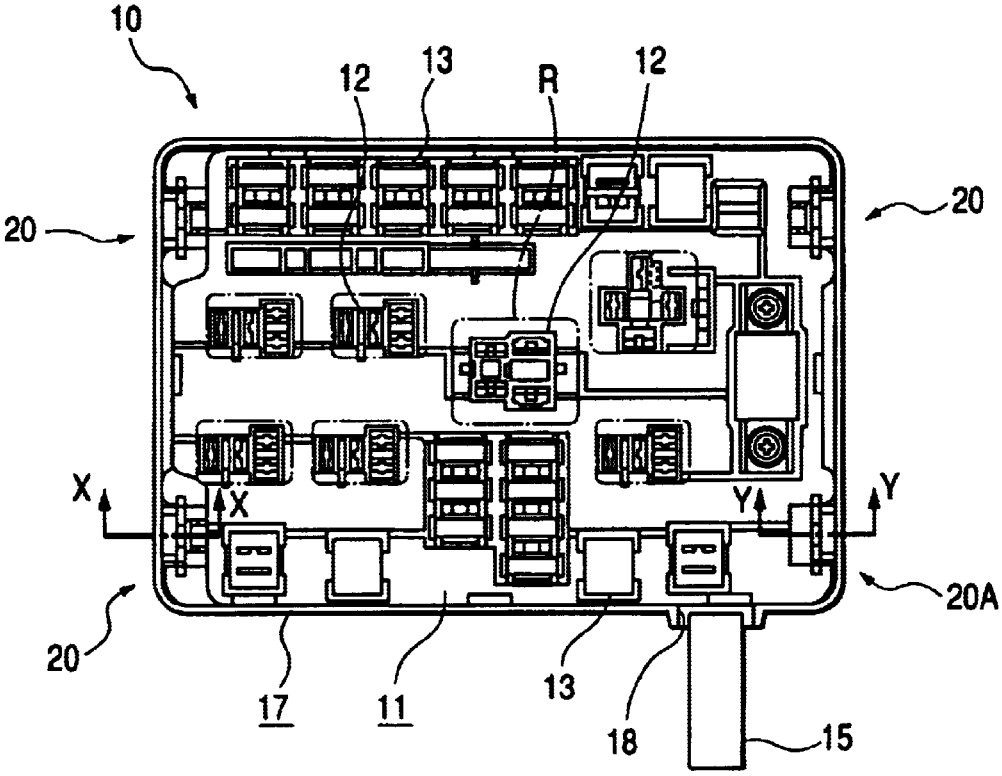
FIG. 1 is a plan view of a first embodiment of a junction box of the present invention.

As shown in FIG. 1, the J/B 10 of this embodiment comprises a body 11, and a cover 17 attached to a lower surface of this body 11. Each of the body and the cover is made of a synthetic resin.

The body 11 has a substantially rectangular shape when viewed from the top. A relay mounting portion 12 for mounting a relay R is provided at a central portion of the upper surface of the body 11, and fuse mounting portions 13 for mounting various fuses (mini-fuses, fusible links and soon) are provided at both sides of the relay mounting portion. Within the body 11, wires, connected respectively to the mounting portions 12 and 13, are bundled into a single wire harness 15 (hereinafter referred to as "W/H"), and this wire harness is extended downwardly (in FIG. 1) from a right end portion of a lower side (in FIG. 1) of this body.

The cover 17 is adapted to be attached to the lower surface of the body 11. The cover 17 is formed into a deep dish-like shape, and has a rectangular shape when viewed from the top. The body 11 can be fitted into a peripheral edge portion of an upper opening of the cover. An escape groove 18 is formed or notched in the edge portion of the upper opening shown at the right end portion of the lower side (in FIG. 1), and the W/H 15, extending outwardly from the body 11, is fitted in and passes through this escape groove 18.

Four lock mechanisms 20 are provided at fitting peripheral surfaces of the body 11 and cover 17, that is, at opposite end portions of shorter side walls of the body 11 and cover 17.

Figure 2:
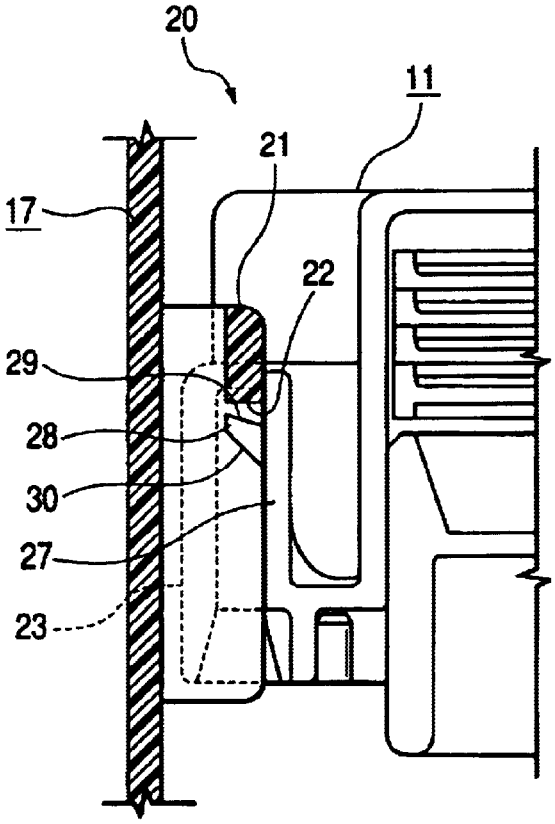
FIG. 2 is a cross-sectional view taken along a line X—X of FIG. 1.
Figure 3:
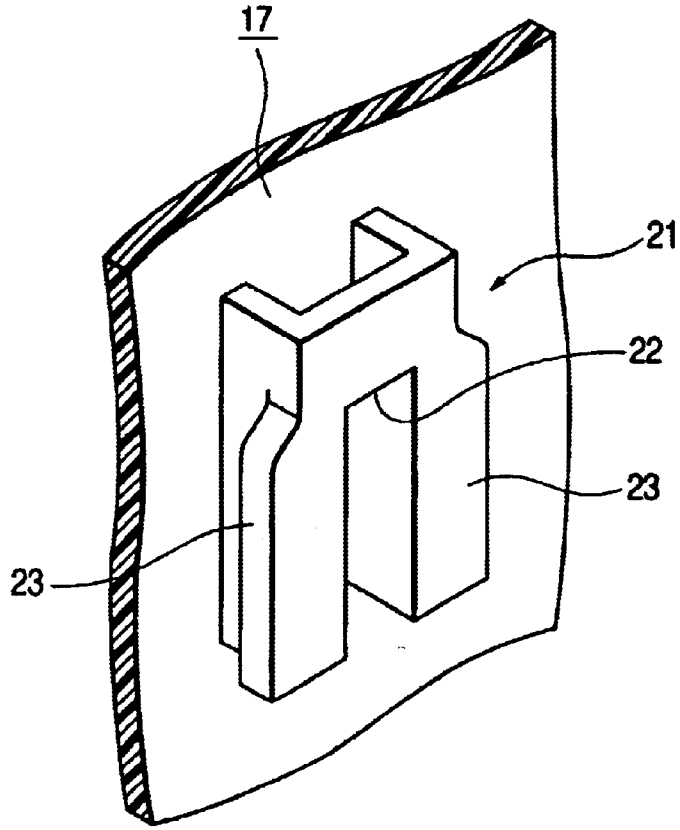
FIG. 3 is a perspective view showing a first mounting portion of a lock mechanism.

The lock mechanisms will be described. First mounting portions 21 are formed on an inner surface of the cover 17 as shown in FIGS. 2 and 3. The first mounting portion 21 is of a hollow structure, and is elongate in a vertical direction. A longitudinal lock groove 22 is formed on a surface of the first mounting portion 21, and is disposed centrally of the width of the surface. Guide wings 23 extend respectively from opposite side edges of the surface.

Figure 4:
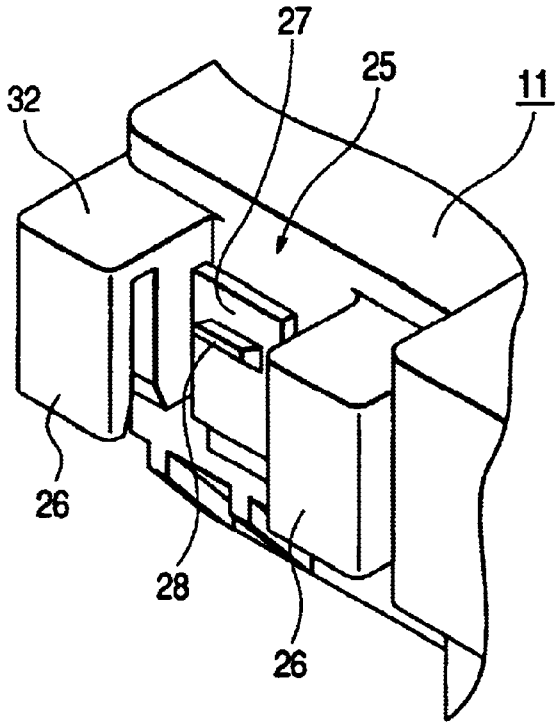
FIG. 4 is a perspective view showing a second mounting portion of the lock mechanism.

On the other hand, second mounting portions 25 are formed on the outer surface of the body 11 corresponding respectively to the first mounting portions 21. As shown in FIG. 4, the second mounting portion 25 has a pair of opposed rails 26 which can receive the guide wings 23 of the first mounting portion 21 respectively. The rails 26 are closed at their upper ends. A lock piece portion 27 is provided between the two rails 26 in a cantilever manner. The lock piece portion 27 first projects outwardly from the outer surface of the body, and then is bent at right angles to extend upwardly. A distal end portion of this lock piece portion can be elastically deformed inwardly and outwardly. A projection 28 for fitting in the lock groove 22 is formed on the outer surface of the distal end portion of the lock piece portion 27. As shown in FIG. 2, an upper surface of the projection 28, serving as an overhanging retaining surface 29, forms an acute angle with the outer surface of the lock piece portion 27. A lower surface of the projection 28, serving as a guide surface 30, is tapering.

Figure 5:
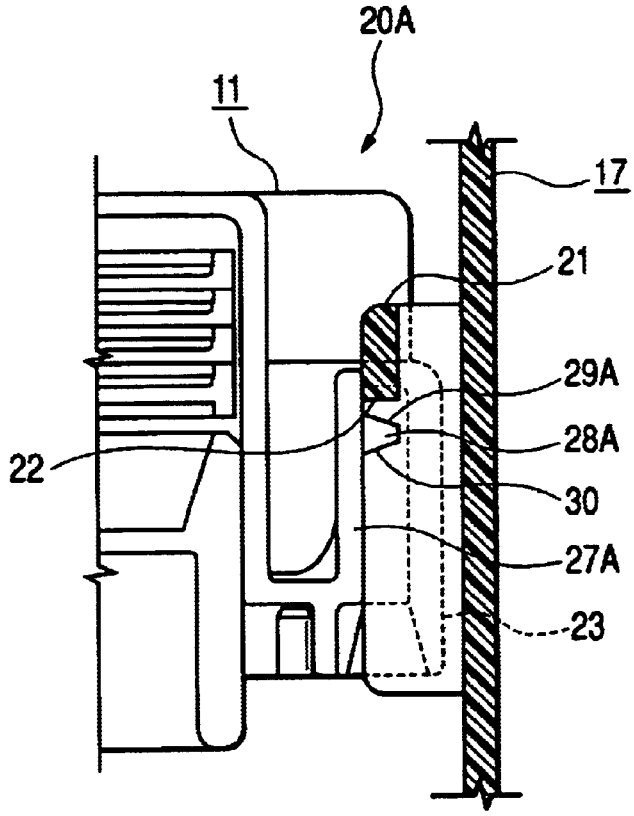
FIG. 5 is a cross-sectional view taken along a line Y—Y of FIG. 1.

In this embodiment, one of the four lock mechanisms 20A which is disposed near to the lower right corner (in FIG. 1), that is, disposed near to the position where the W/H 15 is extended outwardly, a projection 28A of a lock piece portion 27A is formed into a mountain-like shape having upper and lower slanting surfaces, as shown in FIG. 5. A retaining surface 29A of the projection 28A is also tapering and forms an obtuse angle with the outer surface of the lock piece portion 27A. A semi-lock structure is provided between the retaining surface 29A and an upper edge of the lock groove 22 for retaining engagement with this retaining surface 29A.

Next, the operation of this embodiment will be described. For connecting the body 11 and the cover 17 together in a united manner, the body 11 is fitted into the peripheral edge portion of the upper opening of the cover 17 from the upper side in such a manner that the rails 26 of each mounting portion 25 are disposed in registry with the guide wings 23 of the corresponding mounting portion 21, respectively. At this time, each lock piece portion 27, 27A is moved while being elastically deformed to be turned about its proximal end, and when each guide wing 23 is pushed into the rail 26 until the guide wing 23 is brought into engagement with an upper plate 32 of the rail 26, the lock piece portion 27, 27A is elastically restored, and the projection 28, 28A is fitted into the lock groove 22 to be retainingly engaged therein against withdrawal, thereby connecting the body and the cover in a united manner.

The W/H 15, extending from the body 11, is fitted in and passing through the escape groove 18, and is extended downwardly (in FIG. 1). In the lock mechanism 20A disposed near to the position where the W/H 15 is extended outwardly, the tapering retaining surface 29A of the projection 28A on the lock piece portion 27A is retainingly engaged with the upper edge of the lock groove 22 to be held in a semi-locked condition, as shown in FIG. 5.

After the body 11 and the cover 17 are thus connected together in a united manner, mounting legs (not shown), formed integrally with and projecting from the cover 17, are fixedly secured by screws to predetermined portions of a vehicle body respectively, and this junction box is used.

For removing the J/B 10 and particularly the body 11 from the vehicle body when disassembling the vehicle, the W/H 15, extending outwardly as shown in FIG. 1, is gripped and pulled in a direction away from the surface of the sheet of FIG. 1. As a result, there is produced a force to withdraw the body 11 upwardly from the cover 17, and since the lock mechanism 20A, disposed near to the position where the W/H 15 is extended outwardly, has the semi-lock structure as described above, the retaining engagement is relatively easily canceled by elastically deforming the lock piece portion 27A, so that part of the body 11 is withdrawn from the cover 17. Subsequently, in the other three lock mechanisms 20, the lock piece portions 27, while subjected to an inertia force of the above withdrawing operation, are elastically deformed, so that their retaining engagements are canceled in a chain-like manner, and the body 11 is withdrawn from the cover 17, with the cover 17 remaining on the vehicle body.

As described above, in this embodiment, the lock mechanism 20A, disposed near to the position where the W/H 15 is extended outwardly, has the semi-lock structure and providing the smaller retaining force, and therefore the retaining engagement is relatively easily canceled when the W/H 15 is pulled, and the other lock mechanisms 20, while triggered by this canceling operation, are sequentially unlocked, so that the body 11 can be relatively easily removed from the cover 17. The retaining force is reduced in only one lock mechanism 20A, and therefore when the junction box is mounted and used, the required retaining force is sufficiently secured.

(Second Embodiment)

A second embodiment of the present invention will be described with reference to FIG. 6. In a lock mechanism 20B of this embodiment, disposed near to a position where a W/H 15 is extended outwardly, a lock piece portion 27B first projects outwardly from an outer surface of a body, and then is bent at right angles to extend downwardly. This lock piece portion 27B has a downwardly-directed cantilever-shape, and is elastically deformable. A projection 28, formed on the lock piece portion 27B, has an upper surface serving as an overhanging retaining surface 29, while its lower surface serves as a tapering guide surface 30.

The other structure is the same as that of the first embodiment, and those portions, having the same functions as those in the first embodiment, will be designated by identical reference numerals, respectively, and repeated description will be omitted.

Figure 6:
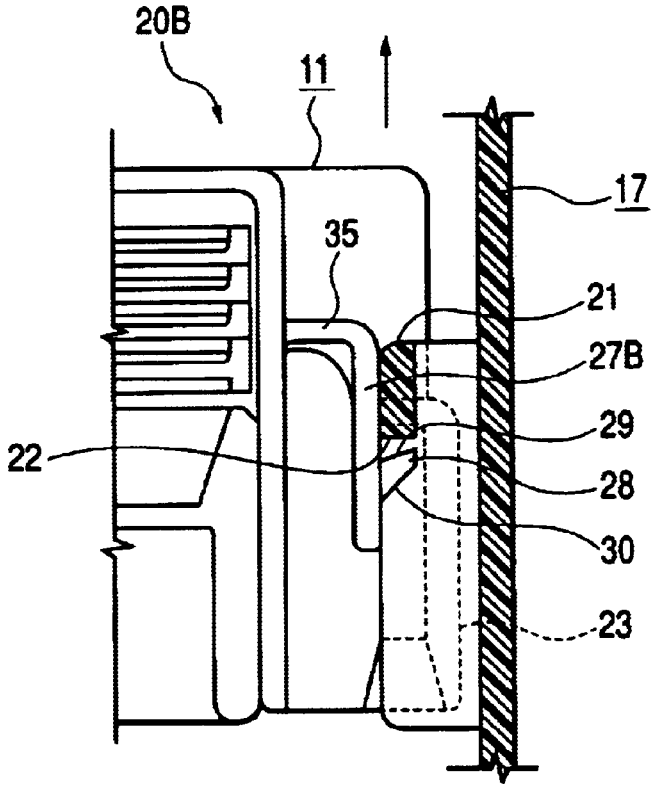
FIG. 6 is a cross-sectional view showing a lock mechanism disposed near to a position where a wire harness is extended outwardly in a second embodiment of the present invention.

In this embodiment, when the W/H 15 is gripped and pulled so as to remove the body 11 of a J/B 10 from a vehicle body during the disassembly of a vehicle, there is produced a force to withdraw the body 11 upwardly from the cover 17 as indicated by an arrow in FIG. 6, and the lock piece portion 27B, provided in the lock mechanism 20B disposed near to the position where the W/H 15 is extended outwardly, is broken at its upper proximal end portion 35 rather than elastically deformed, since this lock piece portion 27B is disposed in a downwardly-directed posture. As a result, the retaining engagement is canceled, and part of the body 11 is withdrawn from the cover 17. In the other lock mechanisms 20, lock piece portions 27, while subjected to an inertia force of this withdrawing operation, are elastically deformed, so that their retaining engagements are canceled in a chain-like manner, and the body 11 is withdrawn from the cover 17, with the cover 17 remaining on the vehicle body.

(Other Embodiments)

The present invention is not limited to the embodiments described above and shown in the drawings, and for example the following embodiments fall within the scope of the present invention. In addition, various modifications can be made without departing from the scope of the invention.

(1) In the semi-lock structure, instead of forming the retaining surface of the projection of the lock piece portion into the tapering surface, the upper edge of the lock groove may be formed into a tapering surface, or both of them may be made tapering.

(2) In contrast with the above embodiments, the lock grooves may be provided at the body while the lock piece portions may be provided at the cover.

(3) There may be adopted a structure in which a hole is formed in each lock piece portion, and the corresponding projection is fitted in this hole.

(4) The present invention can be applied to other types of electric connection boxes such as a relay block.

What is claimed is:

1. An electric connection box comprising:

a connection box body having electrical parts such as a relay and a fuse mounted thereon;

a wire harness being extended outwardly from a predetermined portion of the connection box body;

a cover attached to one surface of the connection box body; and a plurality of lock mechanisms being disposed respectively at regions between the connection box body and the cover, wherein one of the lock mechanisms, disposed near to a position where the wire harness is extended outwardly, has a smaller retaining force than that of the other lock mechanisms.

2. An electric connection box according to claim 1, wherein each of the lock mechanisms includes an elastically-deformable lock piece portion disposed at one of the connection box body and the cover, and a lock portion disposed at the other so as to be retainingly engaged with the lock piece portion, and in the lock mechanism having the smaller retaining force, at least one of mating surfaces of the lock piece portion and the lock portion, which can be retainingly engaged with each other, is tapering to provide a semi-lock structure.

3. An electric connection box according to claim 1, wherein each of the lock mechanisms includes an elastically-deformable lock piece portion disposed at one of the connection box body and the cover, and a lock portion disposed at the other so as to be retainingly engaged with the lock piece portion, and in the lock mechanism having the smaller retaining force, the lock piece portion is disposed in such a posture that the lock piece portion can be easily broken at a proximal end portion thereof when a force, acting to separate the lock piece portion from the lock portion, is applied to the lock piece portion.

* * * * *